US011877713B2

(12) United States Patent
Kwak et al.

(10) Patent No.: US 11,877,713 B2
(45) Date of Patent: Jan. 23, 2024

(54) CLEANER

(71) Applicant: LG ELECTRONICS INC., Seoul (KR)

(72) Inventors: Donghoon Kwak, Seoul (KR); Jaehwan Ko, Seoul (KR); Hyeokjoo Yun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 32 days.

(21) Appl. No.: 17/640,501

(22) PCT Filed: Oct. 1, 2019

(86) PCT No.: PCT/KR2019/012842
§ 371 (c)(1),
(2) Date: Mar. 4, 2022

(87) PCT Pub. No.: WO2021/066220
PCT Pub. Date: Apr. 8, 2021

(65) Prior Publication Data

US 2022/0346609 A1 Nov. 3, 2022

(30) Foreign Application Priority Data

Oct. 1, 2019 (KR) ..... 10-2019-0121688

(51) Int. Cl.
*A47L 5/24* (2006.01)
*A47L 9/28* (2006.01)

(52) U.S. Cl.
CPC ..... *A47L 5/24* (2013.01); *A47L 9/2884* (2013.01)

(58) Field of Classification Search
CPC .... A47L 9/2842; A47L 9/2857; A47L 9/2873; A47L 9/2884; A47L 11/4002;
(Continued)

(56) References Cited

U.S. PATENT DOCUMENTS 6,134,745 A 10/2000 Worwag
2007/0136984 A1* 6/2007 Hsu ..... A47L 5/28 15/339
2010/0050373 A1 3/2010 Kaffenberger et al.

FOREIGN PATENT DOCUMENTS

CN 107028557 8/2017
CN 207666538 7/2018
(Continued)

OTHER PUBLICATIONS

Hindustan Industrial Steels, https://www.hindsteel.com/special-shaped-bright-bar.php, special shaped bright bar (Year: 2023).*
(Continued)

*Primary Examiner* — Brian D Keller
*Assistant Examiner* — Tim Brady
(74) *Attorney, Agent, or Firm* — KED & Associates LLP

(57) ABSTRACT

According to an embodiment of the present disclosure, provided is a cleaner which comprises: a main body having a cylindrical shape; a cyclone unit which is provided inside the main body so as to separate dust from air suctioned into the main body; an extension duct which communicates with the cyclone part and extends from the main body; a suction nozzle which is coupled to the extension duct and suctions dust; a first battery unit which extends from the main body and supplies electric power so that the cyclone unit can suction air; and a second battery unit which supplies electric power to the cyclone unit and is slidably coupled to the extension duct. According to an embodiment of the present disclosure, the usage time of the cleaner can be increased, and the fatigue that a user feels can be minimized even when the usage time is increased.

11 Claims, 7 Drawing Sheets

(58) Field of Classification Search
CPC ..... A47L 11/4005; A47L 11/4008; A47L 11/401; A47L 5/225; A47L 5/24; H02J 7/00; H02J 7/0063; H02J 2007/0067
USPC ..... 15/339, 353
See application file for complete search history.

(56) References Cited

FOREIGN PATENT DOCUMENTS

| | | | | | |
|---|---|---|---|---|---|
| CN | 109199225 | A | * | 1/2019 | ..... A47L 7/0004 |
| CN | 110367873 | A | * | 10/2019 | ..... A47L 5/24 |
| GB | 2550041 | | | 11/2017 | |
| JP | 2003-047577 | | | 2/2003 | |
| JP | 2014-200406 | | | 10/2014 | |
| KR | 10-2007-0021792 | | | 2/2007 | |
| KR | 10-2018-0052586 | | | 5/2018 | |
| WO | WO-2020038423 | A1 | * | 2/2020 | |

OTHER PUBLICATIONS

Vocabulary.com definition of bar-shaped (Year: 2023).*
CN-109199225-A Espacenet description (Year: 2023).*
WO-2020038423-A1 Espacenet description (Year: 2023).*
CN-110367873-A Espacenet description (Year: 2023).*
International Search Report and Written Opinion dated Jul. 1, 2020 issued in Application No. PCT/KR2019/012842.
Extended European Search Report dated Jun. 19, 2023 issued in Application No. 19947848.8.

* cited by examiner

【FIG. 1】
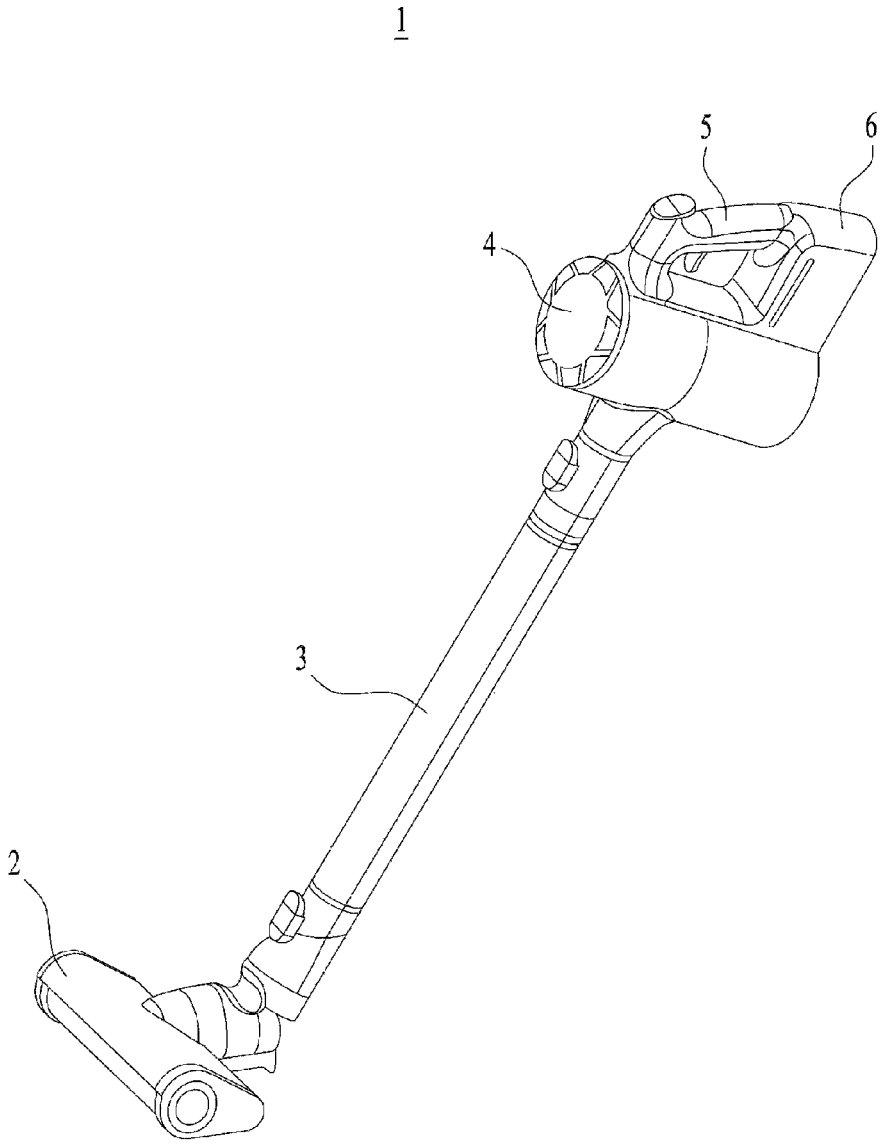

【FIG. 2】
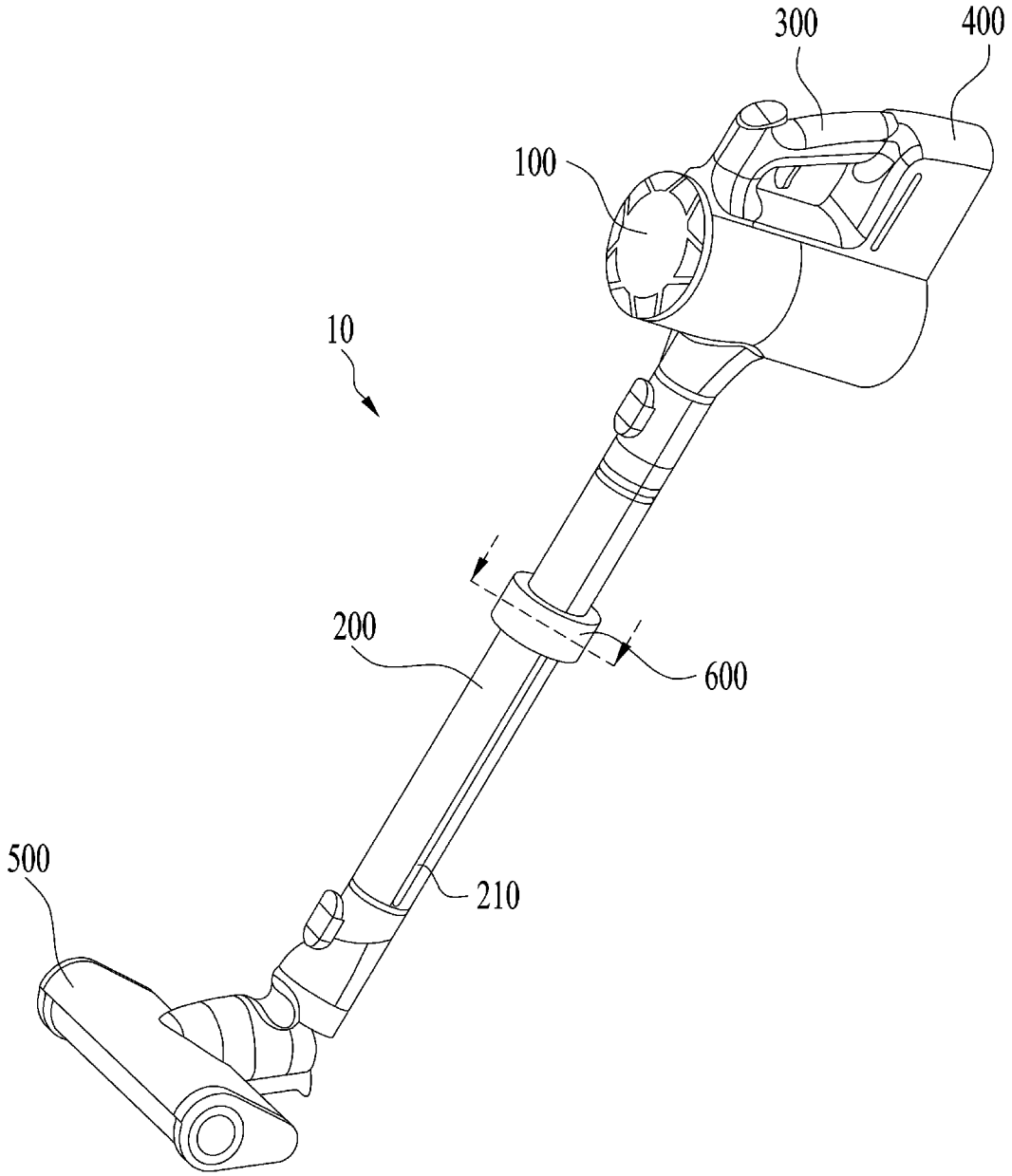

【FIG. 3】
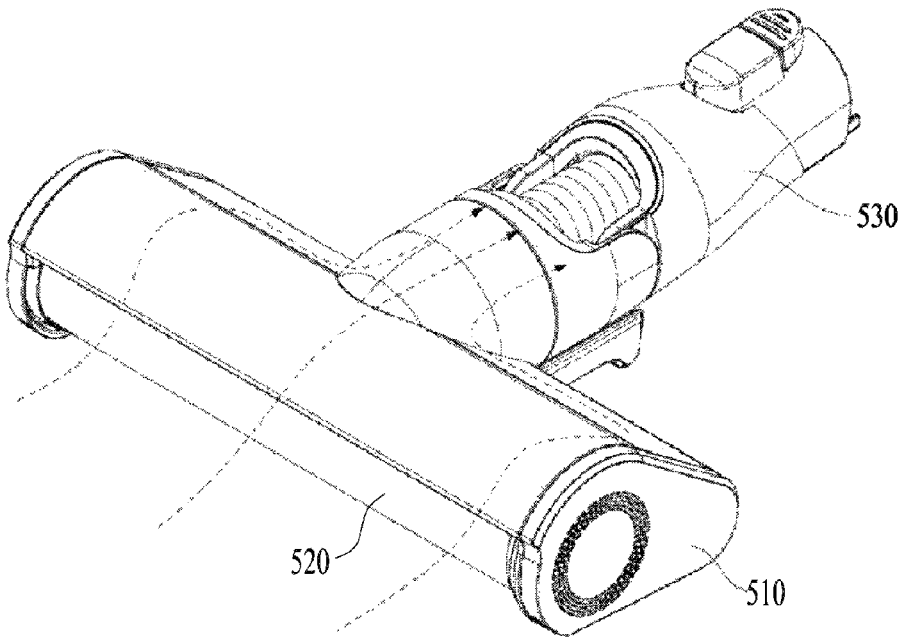

【FIG. 4】
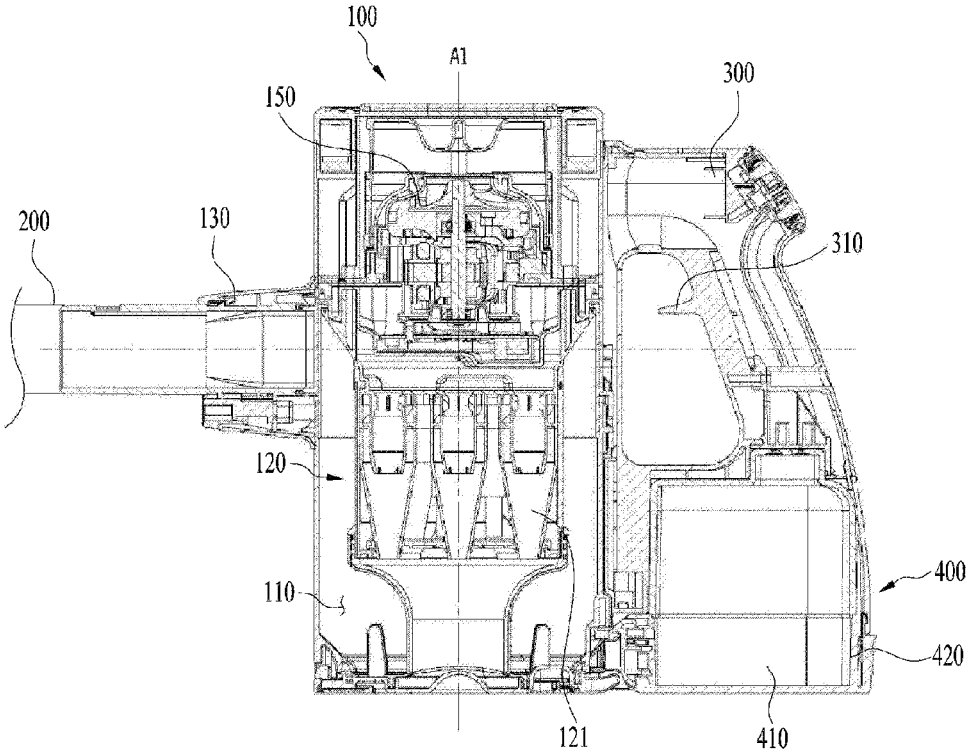

【FIG. 5】
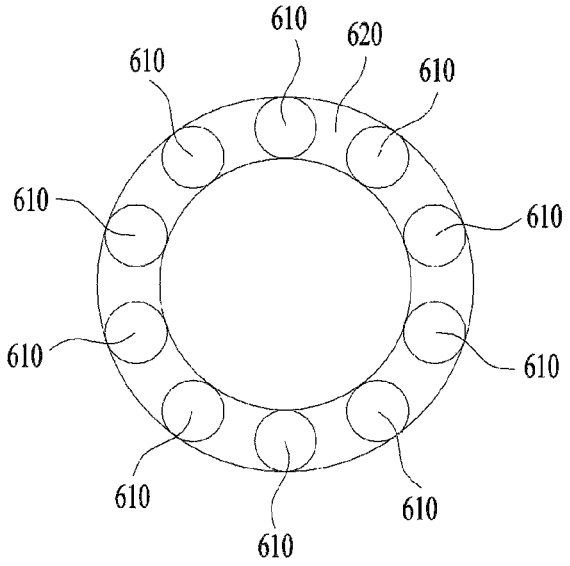

【FIG. 6】
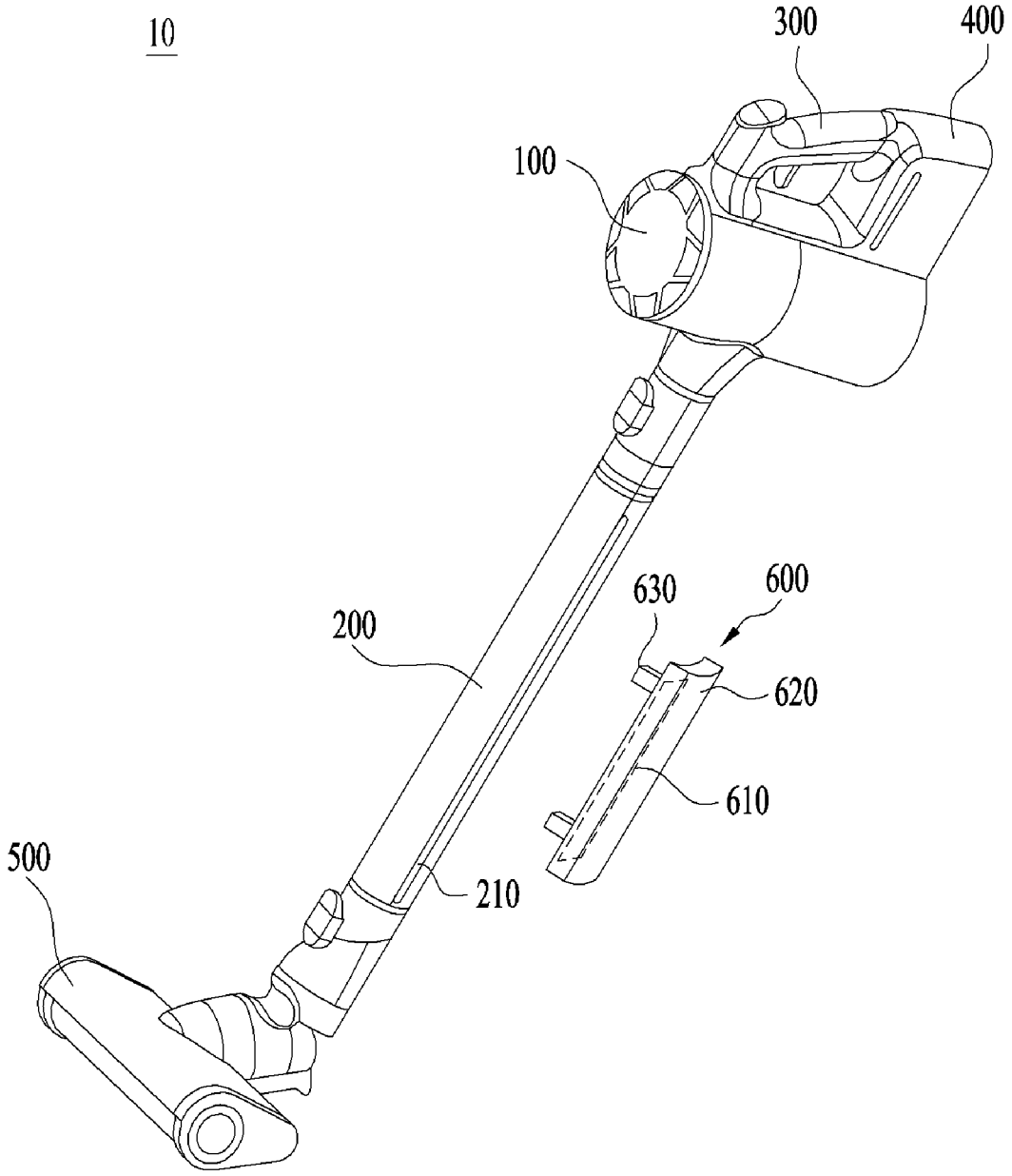

【FIG. 7】
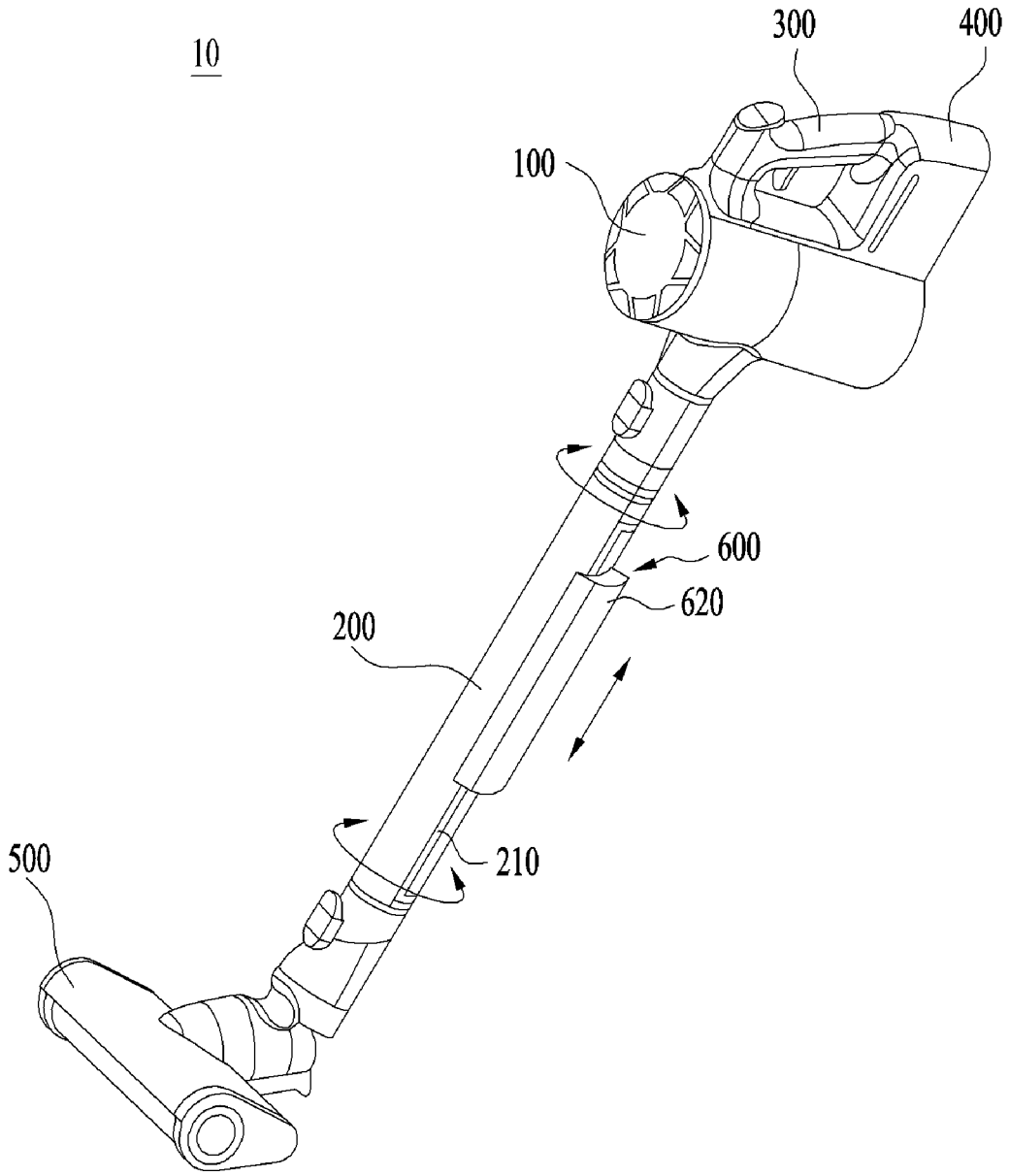

CLEANER

CROSS-REFERENCE TO RELATED PATENT APPLICATIONS

This application is a U.S. National Stage Application under 35 U.S.C. § 371 of PCT Application No. PCT/KR2019/012842, filed Oct. 1, 2019, which claims priority to Korean Patent Application No. 10-2019-0121688, filed Oct. 1, 2019, whose entire disclosures are hereby incorporated by reference.

TECHNICAL FIELD

The present disclosure relates to a cleaner.

BACKGROUND ART

A human cleans a space where he or she lives for hygiene and cleanliness. There may be various reasons for cleaning. For example, a human performs cleaning to protect the body from a disease or to prevent damage to the lungs, and also performs cleaning to keep the space where he or she lives clean and to improve the quality of life.

Dust and foreign substances drop to the floor due to gravity. Therefore, people bend their waist forward to perform cleaning or perform cleaning while sitting down, and thus easily strain their waists or joints.

For this reason, cleaners that help people to perform cleaning have proliferated. Types of cleaners may be roughly classified into a handheld cleaner, a bar-type (upright-type) cleaner, and a robot cleaner.

A general structure of the upright-type cleaner will be described with reference to FIG. 1.

A cleaner 1 may include a suction nozzle 2 for sucking dust, an extension duct 3 through which air sucked in by the suction nozzle 2 is moved, a main body 4 for accommodating a cyclone unit for filtering the air, a handle unit 5 provided at the main body 4, a battery 6 for supplying power, and the like.

Since the upright-type cleaner is not driven in a manner in which power is continuously received through an electric wire or the like, the upright-type cleaner may include a secondary battery, and may be repeatedly used by recharging the same.

However, a battery and a motor for supplying suction power are very heavy and thus account for a large proportion of the weight of the cleaner. In the case of the upright-type cleaner, since both the battery and the motor are provided in the main body or are located adjacent to the main body, a user may easily feel fatigued while performing cleaning.

Further, when the battery is used in the cleaner, the usage time of the cleaner is limited depending on a capacity of the battery, so cleaning may not be smoothly performed.

Accordingly, efforts have been continuously made to develop a cleaner that is capable of being used for a longer time and minimizes the fatigue felt by a user.

Particularly, in Japanese Patent Publication No. 6534205, a storage battery is provided in a state of being accommodated in a storage battery case, and power is supplied to a motor located adjacent to the storage battery case. In this case, a user extends a telescopic pipe of a cleaner so that the user may perform cleaning in a standing state.

However, in this case, there are drawbacks in that since the storage battery and a dust collecting unit are always located at a lower side of the cleaner, steerability of the cleaner deteriorates, and when the cleaner is used, the cleaner is generally oriented at an angle relative to the ground, so the rotational moment acting on the wrist increases and wrist fatigue increases.

DISCLOSURE

Technical Task

According to embodiments of the present disclosure, provided is a cleaner which may secure sufficient usage time thereof.

Further, provided is a cleaner which may increase the usage time of the cleaner and minimize fatigue felt by a user.

In addition, provided is a cleaner that is easy to steer while cleaning.

Technical Solutions

As one example for solving the above-described problems, the present disclosure provides a cleaner including an additional battery in addition to a battery located closer to the hand of a user than the ground when the user uses the cleaner that may be used in a standing state.

Further, the present disclosure provides a cleaner configured to be slidable toward a main body of the cleaner to improve steerability or slidable toward the ground for stable support in spite of using the additional battery.

According to the present disclosure, a cleaner includes a main body provided in a cylindrical shape, a cyclone unit provided in the main body and configured to separate dust from air sucked into the main body, an extension duct configured to communicate with the cyclone unit and to extend from the main body, a suction nozzle coupled to the extension duct and configured to suck dust, a first battery unit configured to extend from the main body and to supply power so that the cyclone unit sucks air, and a second battery unit configured to supply power to the cyclone unit and slidably coupled to the extension duct.

Further, the second battery unit may include a second battery unit case provided to be couplable to the extension duct and a second battery located inside the second battery unit case, the second battery may be provided in plurality, the second battery unit case may be formed to surround at least a part of an outer peripheral edge of the extension duct, and the second battery unit case may be provided in a cylindrical shape including a hollow portion larger than a diameter of the extension duct.

Further, the second battery may be provided in plurality, and the second battery may be arranged in the second battery unit case in a circular shape with respect to the extension duct.

Further, the second battery unit case may be provided in a bar shape including a curved portion corresponding to the outer peripheral edge of the extension duct.

Further, the second battery may be provided in a longitudinal direction parallel to a longitudinal direction of the extension duct. The cleaner may further include a handle unit formed to extend from the main body and provided to be grippable by a user, and a first battery unit case formed to be integrated with the handle unit and configured to form an outer appearance of the first battery unit.

Further, the second battery unit case may be provided to be slidable toward ground or the main body. The cleaner may further include a rail unit formed in the extension duct, and a coupling unit formed in the second battery unit case and coupled to the rail unit to slide the second battery unit case.

Further, the second battery unit case may be provided to be slidable in a circumferential direction on at least a part of the rail unit, and the second battery unit case may be provided to have a width narrower than a diameter of the extension duct.

Advantageous Effects

A cleaner according to embodiments of the present disclosure may clean a wider area by securing sufficient usage time.

Further, even though the usage time increases, the fatigue felt by a user is low, which makes it easier to use the cleaner.

Further, the present disclosure provides a cleaner which may be freely oriented in a direction desired by the user during cleaning.

DESCRIPTION OF DRAWINGS

FIG. 1 is a view showing a cleaner of the related art;

FIG. 2 is a perspective view of the cleaner according to the embodiment of the present disclosure.

FIG. 3 is a partial perspective view of a suction nozzle according to an embodiment of the present disclosure.

FIG. 4 is a cross-sectional view of a cleaner according to the embodiment of the present disclosure.

FIG. 5 is a cross-sectional view of a second battery unit of the cleaner according to the embodiment of the present disclosure;

FIG. 6 is an exploded view of a cleaner according to another embodiment of the present disclosure; and FIG. 7 is a perspective view of the cleaner according to the other embodiment of the present disclosure.

BEST MODE FOR DISCLOSURE

Hereinafter, specific embodiments of the present disclosure will be described with reference to the drawings. The following detailed description is provided to help a comprehensive understanding of the method, the device, and/or the system described in this specification. However, this description is only an example, and the present disclosure is not limited thereto.

In describing embodiments of the present disclosure, when it is determined that detailed description of relevant well-known technologies related to the present disclosure may unnecessarily obscure the gist of the present disclosure, the detailed description thereof will be omitted. The terms to be described later are terms defined in consideration of functions in the present disclosure, and may vary depending on the intention or practice of the user or operator. Therefore, the definitions should be understood based on the overall content of this specification. The terms used in the detailed description are only used to describe the embodiments of the present disclosure, and should not be considered limiting. Unless otherwise clearly specified, an expression in a singular form includes the plural meaning. In this description, an expression such as "include" or "provided with" is intended to indicate certain features, numbers, steps, acts, elements, and parts or combinations thereof, and should not be construed to exclude the presence or possibility of one or more other features, numbers, steps, operations, elements, and parts or combinations thereof other than those described.

FIG. 2 is a perspective view of a cleaner according to an embodiment of the present disclosure, and FIG. 3 is a partial perspective view of a suction nozzle according to the embodiment of the present disclosure.

The cleaner according to the embodiment of the present disclosure, denoted by reference numeral 10, may include a main body 100, cyclone units 110 and 120, an extension duct 200, a suction nozzle 500, a first battery unit 400, and a second battery unit 600.

The suction nozzle 500 is a portion that sucks air including dust in an area to be cleaned. The air sucked through the suction nozzle 500 may be introduced into the main body 100 to be described later through the extension duct 200.

The suction nozzle 500 may include a suction nozzle housing 510, a connection pipe 530, and a rotary cleaning unit 520.

The suction nozzle 500 may be provided to clean the area to be cleaned by coupling the rotary cleaning unit 520 and the connection pipe 530 to the suction nozzle housing 510.

In detail, the suction nozzle housing 510 may be formed such that a front portion thereof open. Further, the suction nozzle housing 510 may be formed to have a wide portion in contact with the ground to prevent a user from unnecessarily moving a lot when performing cleaning.

The rotary cleaning unit 520 may be disposed in the opened portion of the suction nozzle housing 510. The rotary cleaning unit 520 may be rotatably coupled to the suction nozzle housing 510. The rotary cleaning unit 520 disposed in the suction nozzle housing 510 may be rotated by a separate driving unit (not shown).

When the rotary cleaning unit 520 is rotated, dust settling on the ground of the area to be cleaned instantly may rise above the ground and may be easily introduced into the cleaner 10 by a suction force generated by the suction nozzle 500.

The connection pipe 530 may serve to guide the air including dust to the extension duct 200. That is, when the air including dust is introduced into the suction nozzle 500, the air may be transferred to the extension duct 200 to be described later through the connection pipe 530.

The extension duct 200 may be a passage through which the air including dust introduced by the suction nozzle 500 moves. Since the extension duct is provided, a user may use the cleaner in a standing state.

A function of the cleaner 10 may be performed without the extension duct 200, but the user has no choice but to bend his or her back forward or sit down to perform cleaning without the extension duct because the suction nozzle 500 is generally used while being placed on the ground.

However, the present disclosure is not limited thereto. When the connection pipe 530 of the suction nozzle 500 is extended, the connection pipe 530 may serve as the extension duct 200. In this case, the suction nozzle 500 and the main body 100 may be formed to be integrated with each other.

The main body 100 may provide a space for accommodating the cyclone units 110 and 120 to be described later. An external appearance of the main body 100 may be provided in a shape that may serve to assist in forming a cyclone by introducing the air sucked in by a suction motor (not shown) through the suction nozzle 500.

The main body 100 may be provided with a suction unit 130 communicating with the extension duct 200. Accordingly, a suction force generated by the suction motor provided in the main body 100 may be transmitted to the extension duct 200 and the suction nozzle 500. Accordingly, a user may perform cleaning by sucking the air including dust from the ground of the area to be cleaned in a standing state as well.

The cyclone units 110 and 120 may be provided in the main body 100 to separate dust by using a cyclone flow. Specifically, an inner circumferential surface of the main body 100 may be the first cyclone unit 110. A rotation axis A1 of the cyclone flow of the cyclone units 110 and 120 may be provided to be parallel to a longitudinal direction of the main body 100. A longitudinal axis passing through the center of the first cyclone unit 110 may be preferably the rotation axis A1.

The cyclone flow will hereinafter be described in detail. That is, the air introduced into the main body 100 by the suction unit 130 may spirally flow along the inner circumferential surface of the first cyclone unit 110. When the air including dust spirally flows along the inner circumferential surface of the first cyclone unit 110, heavy dust is pushed toward the outside of the first cyclone unit 110 by a centrifugal force, and when the centrifugal force becomes strong, the heavy dust may fall onto a lower surface of the first cyclone unit 110. Accordingly, only air continuously flows, so that dust having a large particle size or heavy dust may be primarily filtered.

The cyclone units 110 and 120 may include the second cyclone unit 120. The second cyclone unit 120 may be provided inside the first cyclone unit 110.

The second cyclone unit 120 may include a cyclone body 121 disposed parallel thereto. The second cyclone unit 120 may separate dust from the air including dust not filtered by the first cyclone unit 110. A filter (not shown) is disposed inside the second cyclone unit 120, and dust is naturally filtered by the filter as air flows.

The dust collected by the first cyclone unit 110 and the dust collected by the second cyclone unit 120 may be separately collected.

Here, the present disclosure is not limited to the above-described configuration of the cyclone units 110 and 120, and any configuration capable of separating dust through an air flow may be operated in a different manner.

A handle unit 300 provided to be gripped by a user may be coupled to the main body 100. The handle unit 300 may be provided in a shape that forms a space into which the user's finger may be inserted so that the user may grip the handle unit 300.

An operation unit 310 is provided in the space into which the user's finger may be inserted, so that the user may easily change a suction strength, a cleaning mode, and the like of the cleaner with his or her finger.

The cleaner 10 according to the embodiment of the present disclosure may include the first battery unit 400.

The first battery unit 400 may include a first battery 410 and a first battery unit case 420.

In this case, the first battery 410 may serve to supply power to the suction motor 150. However, this does not mean that the first battery 410 supplies the power only to the suction motor 150. The first battery 410 may also supply the power to a driving unit of the rotary cleaning unit 520, and when other electrical components are provided in the cleaner 10, the first battery 410 may be provided to supply the power to those electrical components as well.

The first battery unit case 420 may be formed to provide a space for accommodating the first battery 410.

The first battery unit case 420 may form an external appearance of the first battery unit 400. The first battery unit 400 may be formed to be integrated with the handle unit 300.

That is, the first battery unit 400 may be coupled to the main body 100. A stronger suction force may be provided by coupling the first battery unit 400 to the main body 100 for accommodating the cyclone units 110 and 120.

Preferably, the first battery unit case 420 may be disposed at a lower side of the handle unit 300. When the first battery 410 is disposed at the lower side of the handle unit 300, a user may easily grip the cleaner 10.

Generally, a battery accounts for a large proportion of the weight of the cleaner 10. Therefore, when the first battery unit case 420 is provided at an upper side of the handle unit 300, a force applied to the user's wrist is large, which may cause discomfort when using the cleaner 10.

The cleaner 10 according to the embodiment of the present disclosure may include the second battery unit 600. The second battery unit 600 supplies power to the cyclone units 110 and 120 and may be slidably coupled to the extension duct 200.

In the case of the cleaner 10 including the second battery unit 600, the cleaner 10 may receive not only the power supplied from the first battery unit 400 but also the power supplied from the second battery unit 600. Accordingly, the usage time of the cleaner 10 may increase.

In the case of the cleaner including the extension duct 200, the user grips the main body 100 side of the cleaner through the handle unit 300 and performs cleaning. As described above, since the battery accounts for a large proportion of the weight of the cleaner, cleaning may be difficult when the second battery unit 600 is additionally provided.

Accordingly, the second battery unit 600 may be provided to minimize the inconvenience that a user feels when cleaning.

In detail, the second battery unit 600 may be coupled to the extension duct 200. In more detail, the second battery unit 600 may be slidably coupled to the extension duct 200.

The second battery unit 600 may include a second battery unit case 620 provided to be slidable along the extension duct 200, and a second battery 610 accommodated in the second battery unit case 620 and configured to supply power.

The second battery unit case 620 may be provided to be coupled to the extension duct 200. That is, the second battery unit case 620 may be coupled thereto between the suction nozzle 500 and the main body 100 unlike the first battery unit 400 coupled to the main body 100. Since the second battery unit case 620 for accommodating the second battery 610 may be provided to be slidable along the extension duct 200, the second battery unit case 620 may be slidable toward the ground or the main body 100 along the longitudinal direction of the extension duct 200.

In a case in which only the second battery unit 600 is coupled to the extension duct 200, an exterior size of the case may be formed to be smaller than that in a case in which the cyclone units 110 and 120 including a dust bin and the like as well as the second battery unit 600 are coupled to the extension duct 200. Therefore, even though the second battery unit 600 is provided to be biased toward the ground, the user's wrist may not be strained during cleaning.

When the second battery unit case 620 slides along the longitudinal direction of the extension duct 200, the center of gravity of the cleaner 10 may vary. Particularly, when the second battery unit case 620 is moved toward the ground, the center of gravity of the cleaner 10 may be further biased toward the ground, so cleaning may be stably performed. That is, cleaning may be performed without requiring a significant effort by the user.

In addition, when the second battery unit 600 rises upward, a weight of a portion of the cleaner 10 that is adjacent to the ground is less than a weight of a portion thereof that is adjacent to the user's hand. Accordingly, steerability of the cleaner 10 may be improved.

As described above, the user may use the cleaner 10 more conveniently by adjusting a location of the second battery unit 600 depending on the situation.

FIG. 4 is a cross-sectional view of the cleaner according to the embodiment of the present disclosure. Hereinafter, an operation process of the cleaner 10 will be described with reference to FIG. 4.

The suction unit 130 may be provided to communicate with the extension duct 200 or the connection pipe 530 of the suction nozzle 500. In the present disclosure, it is described that the extension duct 200 is inserted into the suction unit 130 for a clear understanding of the present disclosure. Alternatively, as described above, when the connection pipe 530 extends from the suction nozzle 500 so that the user may perform cleaning in an upright state, the suction nozzle 500 may be directly coupled to the suction unit 130.

When air including dust is sucked into the first cyclone unit 110 through the suction unit 130, the air including dust may rotate along the inner circumferential surface of the first cyclone unit 110. The rotation of the air may be generated while an air flow is formed by negative pressure generated by the suction motor 150. As the air including dust rotates on the inner circumferential surface of the first cyclone unit 110, a centrifugal force may be generated to separate the dust and the air. The air from which some dust is removed by the centrifugal force may be introduced into the second cyclone unit 120. After the air introduced into the second cyclone unit 120 passes through the second cyclone unit 120 and then the dust that is not filtered in the first cyclone unit 110 is separated therefrom, the air may be discharged through a cover provided on an upper side of the main body 100.

FIG. 5 is a cross-sectional view of a second battery unit of the cleaner according to the embodiment of the present disclosure. In the cleaner 10 according to the embodiment of the present disclosure, the second battery unit case 620 may be formed to surround at least a part of an outer peripheral edge of the extension duct 200. For example, when the second battery unit case 620 is formed in a circular shape, the second battery unit case 620 may be formed to surround the entire outer peripheral edge thereof, and even when the second battery unit case 620 is formed in a bar shape, the second battery unit case 620 may be formed to surround a part of the outer peripheral edge thereof.

Further, the second battery unit case 620 may be provided to be attachable and detachable to and from the extension duct 200. Accordingly, the cleaner 10 may be used by coupling the second battery unit 600 thereto or removing the second battery unit 600 therefrom according to the user's intention.

For example, when a user cleans only a certain portion of the area to be cleaned, there is no need to secure a large amount of battery usage time, so the cleaner 10 may be used without the second battery unit 600. On the other hand, when there is a large area to be cleaned, the cleaner 10 may be used for a longer time by coupling the second battery unit 600 thereto.

When the second battery unit case 620 is formed in a circular shape, the second battery unit case 620 may be provided in a circular shape. Even when the second battery unit case 620 is formed in the circular shape, the second battery unit case 620 may be provided to be attachable and detachable. An attachment and detachment method may be freely changed at a level that is easy for those skilled in the art.

For example, when the second battery unit case 620 includes a hinge shaft so that a hollow portion of the second battery unit case 620 may be opened, the hollow portion thereof is formed to have a larger diameter than a diameter of the extension duct 200 within a predetermined tolerance, and, as such the second battery unit case 620 may be easily coupled to the extension duct 200.

That is, when the second battery unit case 620 is formed in the circular shape, the second battery unit case 620 may be formed in a cylindrical shape having a hollow portion, a diameter of which is larger than the diameter of the extension duct 200. Forming the hollow portion having the diameter larger than the diameter of the extension duct 200 may not mean that the hollow portion is formed to be significantly larger than the extension duct 200, but mean that, as described above, the hollow portion has the predetermined tolerance thereof to the extent that the second battery unit case 620 may be formed to be coupled thereto.

The second battery 610 accommodated in the second battery unit case 620 may be provided to have a longitudinal direction parallel to the longitudinal direction of the extension duct 200. Accordingly, a plurality of second batteries 610 may be accommodated in the second battery unit case 620. The plurality of second batteries 610 may be provided therein not only when the second battery unit case 620 is formed in the cylindrical shape, but also when the second battery unit case 620 is formed in a bar shape as will be described later.

The second battery 610 may be provided in a cylindrical shape. When a plurality of second batteries 610 are provided, the plurality of second batteries 610 may be arranged in a circular shape based on the center of the extension duct 200 in the second battery unit case 620.

When the second battery 610 and the second battery unit case 620 are provided in the cylindrical shape, and the second battery 610 is arranged in the circular shape based on the center of the extension duct 200, as shown in FIG. 5, the second battery unit case 620 may be formed to accommodate as many second batteries 610 as possible. In this case, the usage time of the cleaner 10 may be maximized.

There is no upper limit on the number of second batteries 610, but, of course, the second batteries 610 may be disposed to be spaced apart from each other so as to secure a sufficient gap between the second batteries 610.

The usage time of the cleaner 10 increases as the capacity of the battery increases, but the feeling of fatigue caused by the weight of the battery may increase. Therefore, the number of second batteries 610 may be appropriately selected, rather than excessively increasing the battery capacity, in consideration of both the demerit whereby the fatigue felt by a user may increase and the merit whereby the usage time may increase.

FIG. 6 is an exploded view of a cleaner according to another embodiment of the present disclosure.

According to the other embodiment of the present disclosure, the second battery unit 600 of the cleaner 10 may be formed in a bar shape.

An external appearance of the second battery unit 600 may be determined depending on a shape of the second battery unit case 620. When the second battery unit case 620 is provided in the bar shape, the second battery unit case 620 may be coupled to a portion corresponding to a part of the outer peripheral edge of the extension duct 200.

The second battery unit case 620 may be coupled to the extension duct 200. Specifically, the second battery unit case 620 may be coupled to be slidable toward the ground or the main body.

When the second battery unit 600 is provided in the bar shape, the second battery unit 600 is not required to completely cover the circumference of the extension duct 200, and may be formed to cover only a part of the outer peripheral edge thereof, so that a user may more easily attach and detach the second battery unit 600 to and from the extension duct 200.

Battery consumption may vary depending on various factors such as a size of the area to be cleaned or a material of a floor surface thereof, and battery consumption generally increases in proportion to the size of the area to be cleaned. The first battery unit 400 is generally provided to be integrated with the cleaner 10. Since the second battery unit 600 serves to supply additional power in addition to the power supplied from the first battery unit 400, it may not be desirable to significantly increase the battery capacity thereof.

That is, since it is desirable for the cleaner 10 to have enough battery capacity to clean the area to be cleaned, the second battery unit 600 does not need to be provided to supply excessive power.

The extension duct 200 may include a rail unit 210. The rail unit 210 may be provided in a groove shape in the extension duct 200.

The second battery unit 600 may include a coupling unit 630. The coupling unit 630 may be inserted into the rail unit 210, thereby serving to couple the second battery unit 600 to the extension duct 200.

Further, the coupling unit 630 may allow the second battery unit 600 to slide along the rail unit 210 in the longitudinal direction of the extension duct 200 (toward the ground or the main body of the cleaner).

A fixing unit (not shown) to which the second battery unit 600 is fixed may be provided in at least one of the coupling unit 630 or the rail unit 210. Accordingly, a user may locate the second battery unit 600 at a desired location in the longitudinal direction of the extension duct 200.

When the second battery unit 600 is disposed at a lowermost side of the extension duct 200, the center of gravity may be biased downwards, thereby minimizing the fatigue felt by the user. However, in a special situation such as cleaning a narrow gap, since it may be more effective to dispose the second battery unit 600 at an upper side of the extension duct 200 than at the lowermost side thereof, it is desirable that the second battery unit 600 is provided to be slidable, and also to be capable of being fixed at any location along the rail unit 210 in the longitudinal direction.

FIG. 7 is a perspective view of the cleaner according to the other embodiment of the present disclosure.

The rail unit 210 of the cleaner 10 according to the other embodiment of the present disclosure may be formed to extend in a direction parallel to the longitudinal direction of the extension duct 200. Accordingly, the second battery unit 600 may be coupled to the rail unit 210 and slidable therealong toward the ground or the main body.

Meanwhile, the rail unit 210 may be provided so as to form a straight line overall, but is not limited thereto. For example, at least a part of the rail unit 210 may be provided to rotate the second battery unit 600 in a circumferential direction of the extension duct 200.

At least a part of the rail unit 210 may be formed in a circumferential direction. For example, the rail unit 210 may be formed in a rectangular shape, one side of which is open, or in a shape of the letter E. Accordingly, the second battery unit 600 may be slidable in the circumferential direction.

When the second battery unit 600 is slidable in the circumferential direction, the second battery unit 600 may be effective in special situations such as when cleaning a narrow gap. For example, when cleaning is performed to clean a gap that is wider than the diameter of the extension duct 200 but smaller than the sum of thicknesses of the extension duct 200 and the second battery unit 600, thorough cleaning may not be performed due to the volume of the second battery unit 600. In this case, when the second battery unit 600 is slid in the circumferential direction, the extension duct 200 may enter and exit through the gap, so cleaning may be further easily performed.

While representative embodiments of the present disclosure have been described in detail above, it will be understood by those skilled in the art to which the present disclosure pertains that various modifications may be made in the embodiments without departing from the spirit and scope of the present disclosure. Therefore, the scope of the present disclosure should not be limited to the embodiments, and should be defined not only by the claims to be described later but also by equivalents to the claims.

What is claimed is:

1. A cleaner comprising:

a main body provided in a cylindrical shape;

a cyclone unit provided in the main body and configured to separate dust from air sucked into the main body;

an extension duct configured to communicate with the cyclone unit and to extend from the main body;

a suction nozzle coupled to the extension duct and configured to suck dust;

a first battery unit configured to extend from the main body and to supply power so that the cyclone unit sucks air; and a second battery unit disposed between the main body and the suction nozzle, configured to supply power to the cyclone unit, and the second battery unit is movably coupled to the extension duct, wherein the second battery unit comprises a second battery unit case to be coupled to the extension duct, and a second battery disposed inside the second battery unit case, and wherein the second battery unit case is slidably provided between the suction nozzle and the main body in a longitudinal direction of the extension duct.

2. The cleaner of claim 1, wherein the second battery is provided in plurality.

3. The cleaner of claim 2, wherein the second battery unit case is formed to surround at least a part of an outer peripheral edge of the extension duct.

4. The cleaner of claim 3, wherein the second battery unit case is provided in a cylindrical shape including a hollow portion larger than a diameter of the extension duct.

5. The cleaner of claim 4, wherein the second battery is arranged in the second battery unit case in a circular shape with respect to the extension duct.

6. The cleaner of claim 3, wherein the second battery unit case is provided in a bar shape including a curved portion corresponding to the outer peripheral edge of the extension duct.

7. The cleaner of claim 1, wherein the second battery is provided in a longitudinal direction parallel to the longitudinal direction of the extension duct.

8. The cleaner of claim 7, further comprising:

a handle unit to extend from the main body and configured to be grippable by a user; and a first battery unit case to be integrated with the handle unit and configured to provide an outer appearance of the first battery unit.

9. The cleaner of claim 1, further comprising:

a rail unit disposed in the extension duct; and a coupling unit disposed in the second battery unit case and coupled to the rail unit to slide the second battery unit case.

10. The cleaner of claim 9, wherein the second battery unit case is provided to be slidable in a circumferential direction on at least a part of the rail unit.

11. The cleaner of claim 10, wherein the second battery unit case is provided to have a width narrower than a diameter of the extension duct.

* * * * *